US006080459A

United States Patent [19]

Keller

[11] Patent Number: 6,080,459

[45] Date of Patent: Jun. 27, 2000

[54] DECORATIVE PACKAGING RIBBON

[75] Inventor: Shiela Keller, Milwaukie, Oreg.

[73] Assignee: Creative Concepts Unlimited, LLC, Portland, Oreg.

[21] Appl. No.: 08/778,933

[22] Filed: Jan. 3, 1997

Related U.S. Application Data

[62] Division of application No. 08/497,962, Jul. 3, 1995, Pat. No. 5,691,023, which is a continuation of application No. 07/909,230, Jul. 6, 1992, abandoned.

[51] Int. Cl.[7] ..... B65D 65/28

[52] U.S. Cl. ..... 428/43; 223/46; 428/4; 428/5; 428/24; 428/136; 428/355 RA

[58] Field of Search ..... 428/4, 5, 24, 43, 428/136, 355 RA; 223/46

[56] References Cited

U.S. PATENT DOCUMENTS

| | | | |
|---|---|---|---|
| 2,397,415 | 3/1946 | Ghez | 428/136 |
| 2,826,225 | 3/1958 | Hagenbuch | 428/5 |
| 3,479,243 | 11/1969 | Doig | 428/5 |
| 4,812,338 | 3/1989 | Masui | 428/4 |
| 5,154,485 | 10/1992 | Fleishman | 297/445 |
| 5,240,750 | 8/1993 | Cheng | 428/136 |

FOREIGN PATENT DOCUMENTS

| | | | |
|---|---|---|---|
| 1079524 | 6/1980 | Canada | 428/136 |
| 2921674 | 12/1980 | Germany | 428/4 |

*Primary Examiner*—Nasser Ahmad

*Attorney, Agent, or Firm*—Kolisch, Hartwell, Dickinson, McCormack & Heuser

[57] ABSTRACT

A decorative ribbon is provided with a controllable adhesive on portions of the underside, whereby the ribbon may be adhered to an article and removed from the article for relocating it on the article, if desired. The ribbon also is cut through along predetermined lines to form decorative design elements in the ribbon. The cut lines are interrupted by uncut portions of the ribbon, whereby the decorative design elements may be displaced out of the plane of ribbon along the cut lines by bending at the uncut portions, whereby to form stand-up decorative design elements which project outwardly from the ribbon while remaining attached to the ribbon by the uncut portions. A flare ribbon is formed by a plurality of longitudinally spaced, V-shaped, serrated perforation cut lines which allow the ribbon to be separated along the cut lines and flared laterally outward. A stretch ribbon is formed by a plurality of cuts extended laterally inward from opposite sides of a length of ribbon, in alternate arrangement, beyond the center of the ribbon, allowing the ribbon to be stretched to lengths substantially greater than the original length of the ribbon.

4 Claims, 5 Drawing Sheets

DECORATIVE PACKAGING RIBBON

This application is a division of application Ser. No. 08/497,962, filed Jul. 3, 1995, now U.S. Pat. No. 5,691,023, as a continuation of application Ser. No. 07/909,230, filed Jul. 6, 1992, abandoned.

BACKGROUND OF THE INVENTION

The present invention relates generally to decorative packaging, and particularly to decorative packaging ribbons.

A long tradition in our society is the wrapping of gifts in special ways to enhance recognition and appearance. In general, wrapping paper incorporates design features pertinent to particular holidays and special events, lending a distinctive flavor to the gift or other presentation aspects of the gift and associated packaging. The use of decorative ribbons for such gift wrapping has been a staple of the gift wrapping industry for decades. It is virtually expected that gift wrappings include the use of decorative ribbons. The decorative ribbon industry is characterized by dependability, but often little innovation. While decorative ribbon is available in various materials, styles, colors and textures, the basic design approaches have not undergone significant change for many years.

Decorative ribbon is generally provided as long, narrow and thin sheets of flat material with uniform thickness and parallel sides. To attach decorative ribbon to a package, a segment of decorative ribbon is required of sufficient length to surround a package and allow tieing of the ribbon to maintain the ribbon upon the package. Accordingly, use of such ribbons can require significant lengths of ribbon material in order to attach to a package.

As wrapped about a package, a thin flat ribbon offers no spatial character beyond that of its two dimensional aspects lying flat against the surface of the package. Ribbon bows are created by gathering portions of the ribbon together to produce a non-planar effect. Ribbons may be curled, e.g., as by capturing the ribbon between the thumb and a scissor edge and pulling the ribbon therethrough, to provide a non-planar effect. While such non-planar effects add to the usefulness of the ribbon as a decorative feature on a gift package, such bows and curled ribbons are commonplace and lack the important utility of providing distinctiveness in gift wrapping.

In some cases, ribbons have decorative edge patterns provided by cutting away side portions of the ribbons. Such decorative edge patterns do not, however, enhance the ribbons beyond their natural two dimensional character. As a result, such ribbons are generally expensive in relation to the decorative utility provided.

Decorative tape, including permanent adhesive on a backside and a decorative front side, is believed to exist, but such material is not well adapted for creative presentation in that the permanent adhesive does not allow repositioning or reuse of the decorative tape and the presentation remains generally planar.

In another aspect of conventional decorative ribbon products and use, the user is permitted limited creativity in applying such decorative ribbons to a package. The user must essentially accept the configuration of the ribbon with little operational features of the ribbon available for creative variation in presentation. For any two package configurations developed with the same ribbon products, each would bear substantial similarity to the other by virtue of the inability of such products to allow user selected variation in presentation. In other words, conventional ribbon products have limited operational characteristics supporting user innovation in presentation.

Accordingly, ribbon products offering new design innovation and operational characteristics will find great utility in the decorative ribbon industry. It is desirable, therefore, that decorative ribbon products go beyond the bounds of the prior constraints of simple flat, thin, parallel edged sheets of ribbon material.

SUMMARY OF THE INVENTION

In accordance with one aspect of the present invention, a decorative ribbon may be used in combination with controllable adhesive permitting application of the ribbon by such adhesive to gift wrapping paper with sufficient adherence to maintain the ribbon upon the gift wrapping paper, but weak enough to allow removal, e.g., for selected repositioning or reuse, of the ribbon. This allows use of selected ribbon length and positioning not restricted by a need to tie the ribbon about the package.

In accordance with another aspect of the present invention, a decorative ribbon includes an incomplete die cut within the interior region of the ribbon so as to provide a decorative stand-up portion which may be positioned out of the plane of the ribbon but remain attached to the body of the ribbon for a three dimensional decorative effect. The stand-up portion may be provided by including a die notch strategically located so that the die cut maintains a coupling structure, i.e., an uncut portion of ribbon, between the stand-up portion and the ribbon. The user can then leave the stand-up portion in a three dimensional standing position. Alternatively, the user can detach the stand-up portion completely from the ribbon body leaving a cutout or aperture in the ribbon. Also, the stand-up portion may be provided with controllable adhesive on its back for selective attachment about the gift wrapping paper or ribbon bows of a package. Further variation would include printing of a design corresponding to the die cut pattern on the ribbon.

In accordance with another aspect of the present invention a stretch ribbon includes die cuts laterally inward from the outer sides of the ribbon, with successive cuts appearing on alternate sides of the ribbon. Deep, narrow spacings are possible with ribbons of more flexibility and strength which can be then elongated far beyond the length of the original ribbon stock.

In accordance with another aspect of the present invention, a flare ribbon is produced by angled die cutting inward from one or both outer edges of the ribbon. The result is a ribbon which flares along its length. The flare pattern can be used with various widths and colors of ribbon for a cumulative effect providing the important utility of distinctiveness in gift wrapping applications. By providing a narrow strip of controllable adhesive down the ribbon backside, the flare portions may be selectively positioned, or detached from the ribbon and repositioned at various locations about the gift wrapping paper or gift package.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENTS

The present invention as illustrated in various embodiments herein may be used in conjunction with controllable adhesive for the purpose of attaching the ribbon products to, for example, gift wrapping paper or other portions of a gift package. As used herein, the term "controllable adhesive" shall refer to an adhesive material suitable for attachment to a given surface and removal therefrom without damage to the given surface. Thus, the magnitude and nature of adhesion of such controllable adhesive may be with reference to the particular surface to which attachment is made. As for the typical use of the present invention as applied to decorative ribbons for attachment to gift wrapping paper surfaces and other such packaging material, a controllable pressure sensitive adhesive can be of the type commonly used on POST-IT™ brand self-sticking removable notes available from Minnesota Mining and Manufacturing, Inc. More particularly, several such controllable adhesives are contemplated as being appropriate for use in practice of the present invention. Each of these adhesive products are available from Minnesota Mining and Manufacturing, Inc. as a double-back tape product, i.e., a tape having adhesive on both sides. Product numbers for the adhesives illustrative of the type of adhesive appropriate for use in practice of the present invention include Minnesota Mining & Manufacturing, Inc. product numbers 9425, 9415PC, and 920XL.

Each of the embodiments of the present invention shown herein may be used with controllable adhesive and, it is suggested, that such products be provided in roll and, if necessary, include a protective backing strip along the length of the product to isolate the controlled adhesive from the adjacent top surface of the ribbon product in such rolled configuration.

Figure 1:
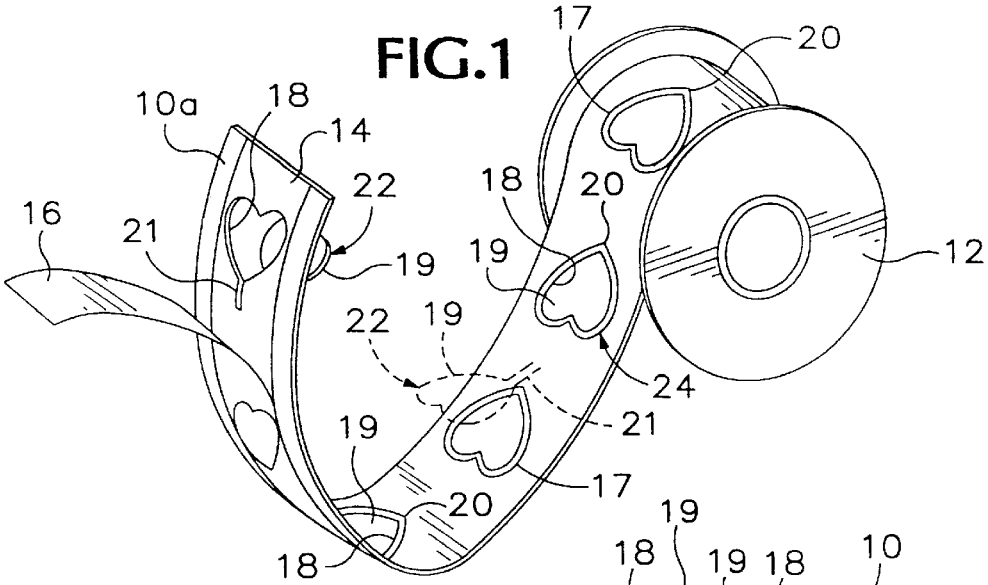
FIG. 1 illustrates a decorative ribbon product according to the present invention including a controllable adhesive backing and selectively removable stand-up portions.

FIG. 1 illustrates a decorative ribbon product 10 according to a first embodiment of the present invention. In FIG. 1, the decorative ribbon product 10 takes generally the form of a long strip of ribbon material as may be provided on a roll 12. The decorative ribbon product 10 includes on its back surface 10*a* a controllable adhesive 14 which may be protected against inadvertent adhesion by a back strip 16 held against the length of the backside 10*a* of ribbon product 10 by virtue of such controllable adhesive. Ribbon product 10 includes along its length die cuts 18, in the illustrated embodiment of FIG. 1 heart-shaped patterns. The die cuts 18 define interior or stand-up portions 19. It is suggested that the width of the back strip 16 be greater than the width of the die cut 18 to avoid severing of the back strip 16 into small length portions. It is further suggested that the die cut 18 be a "kiss cut" which partially severs the ribbon product 10 enough to allow manual separation therealong, but does not sever the back strip 16.

In accordance with the present invention, each cut 18 is formed by what will be referred to herein as an incomplete die cut. According to such incomplete die cut, the cuts 18 do not perforate entirely the thickness of the ribbon product 10 such that the stand-up portions 19 normally remain within the plane of the ribbon product 10, but may be easily detached along the cut 18. Furthermore, such incomplete die cuts would include an entirely unsevered portion 20 through which no cutting of the product 10 is accomplished. Thus, at the uncut portion 20 the stand-up portion 19 remains fully attached to the remainder of the ribbon product 10.

Figure 2:
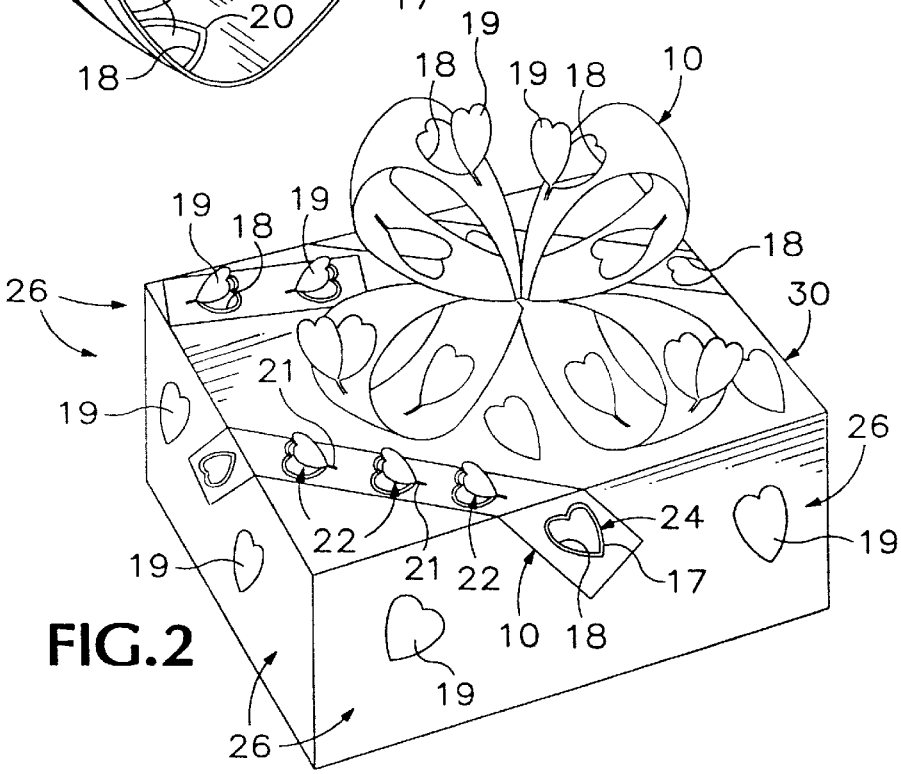
FIG. 2 illustrates use of the decorative ribbon product of FIG. 1 on a gift package including detachment and selective placement of the stand-up portions.

By virtue of such incomplete die cuts the stand-up portions 19 provided by cuts 18 may be selectively pulled up as shown at reference numerals 22, left within the plane of ribbon product 10 as shown at reference numerals 24, or removed entirely from the body of ribbon product 10 and repositioned elsewhere on a package as shown at reference numerals 26 (FIG. 2). Also, by use of suitable ribbon material for the product 10, the stand-up portion 19 may be provided with a supporting tab 21 by tearing the stand-up portion 19 partially along the length of the ribbon 10. More particularly, it is suggested for implementation of this feature that the structure of ribbon product 10 include primarily lengthwise elongate fiber elements allowing controlled, i.e., straight line, tearing along the length of the ribbon product 10 and between such fiber elements. As may be appreciated, the length of tab 21 may be varied according to user preference and spacing between die cuts 18.

FIG. 2 illustrates such selective use and placement of the stand-up portions 19 of the ribbon product 10. Thus, in FIG. 2 the ribbon product 10 may be attached to a gift package 30, i.e., wrapping paper surrounding a package, by virtue of the controllable adhesive 14. Such attachment of product 10 to package 30 may be in conventional fashion wherein the product 10 surrounds the package 30, or may include short length segments of product 10 attached to package 30 by virtue of the controllable adhesive 14. Also, the product 10 may be configured as a bow structure as shown in FIG. 2.

Figure 8:
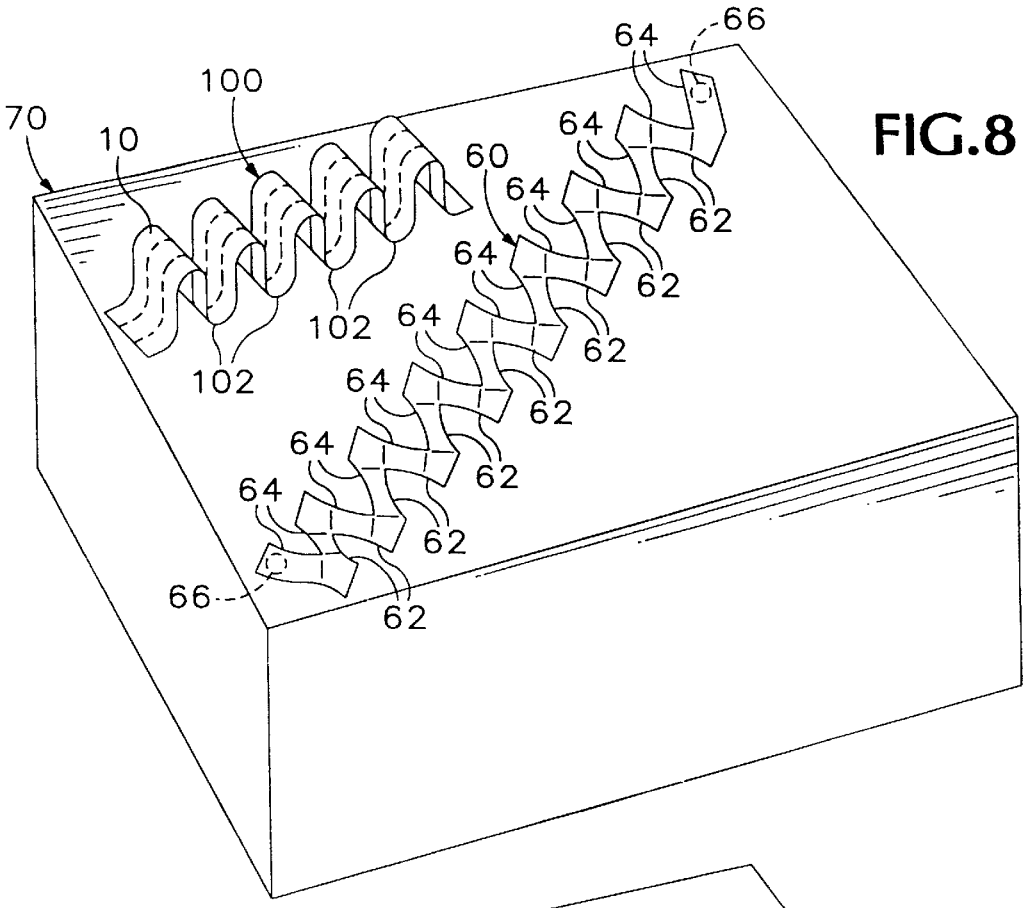
FIG. 8 shows length expansion of the decorative stretch ribbon product of FIG. 7 and attachment at each end of a length portion thereof to a gift package to maintain the expanded length condition.

As may be appreciated, the use of controllable adhesive allows the ribbon product 10 to be selectively placed about the package 30 and, if necessary, removed for repositioning or reuse as needed. Because the ribbon product 10 may include the controllable adhesive 14 on its backside the ribbon product 10 need not surround the entire package in order to be secured to the package. In other words, shorter length segments of the ribbon product 10 may be applied by use of the controllable adhesive 14. FIG. 8 illustrates a wave configuration 100 for the ribbon product 10 whereby the ribbon product 10 is attached to the package 70 at intermittent points 102 along its length. The spacing between the intermittent points 102 of ribbon product 10 is greater than the corresponding contact points of the ribbon product 10 of the package 70 such that the ribbon product 10 forms an undulating or wave-like structure providing a three dimensional effect apart from the use of the stand-up portions 19. Thus, versatility of the ribbon product 10 in its selected use according to user preference supports a broader range of package design presentation.

FIGS. 3A–3D show variation in the die cut patterns 18, each including incomplete die cuts 18, including uncut portions 20, for the purpose of selectively positionable stand-up portions 19 and controllable adhesive 14 as illustrated above in connection with the embodiment of FIGS. 1 and 2. By use of a small inventory of such ribbon products 10, it is possible to achieve a multi-color print effect by selectively coordinating different ribbon products 10 of different colors and detaching various stand-up portions 19 for placement on different colored ribbon products 10. Thus, the relatively more expensive multi-color print effect is achieved with an inventory of relatively inexpensive single color ribbon products.

Figures 3A, 3B, 3C:
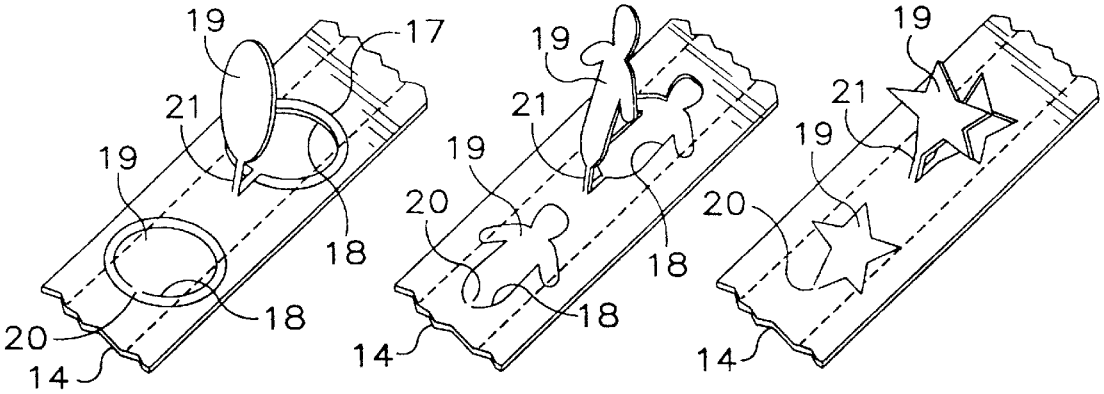
FIGS. 3A–3D illustrate variation in the die cut patterns for the decorative ribbon product of FIG. 1.
Figure 3D:
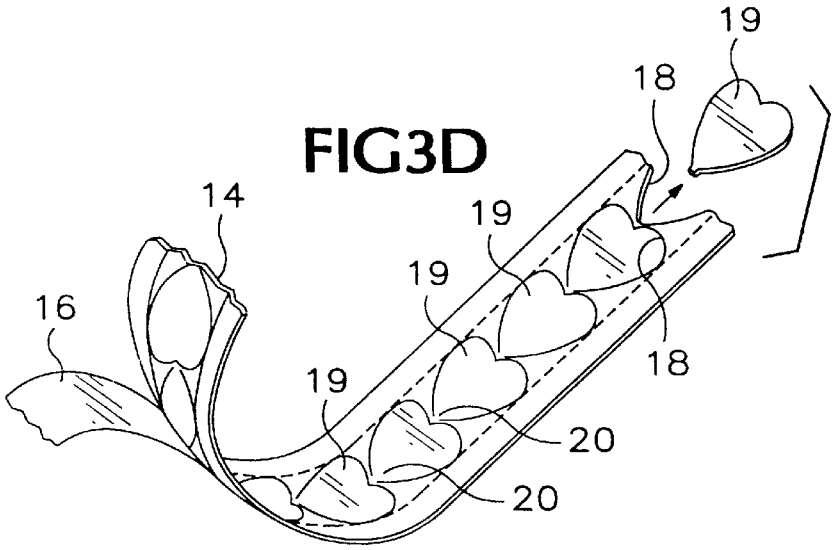

It is to be noted that the adhesive layer 14 in FIG. 1 terminates inwardly of the lateral sides of the ribbon 10, leaving laterally outward portions of the ribbon not covered with adhesive. Also, FIGS. 3A, 3B and 3C show that portions of the stand-up decorations 19, defined by the die cut lines 18, extend laterally beyond the lateral margins of the adhesive layer and into the laterally outward portions of the ribbon not covered with adhesive. Accordingly, it is evident that some portion of the die cuts 18 extend through the thickness of the ribbon and any underlying adhesive layer that the die cuts intercept, and that other portions of the die cuts extend only through the thockness of the ribbon where there is no underlying adhesive to be intercepted by the die cuts.

Figure 4:
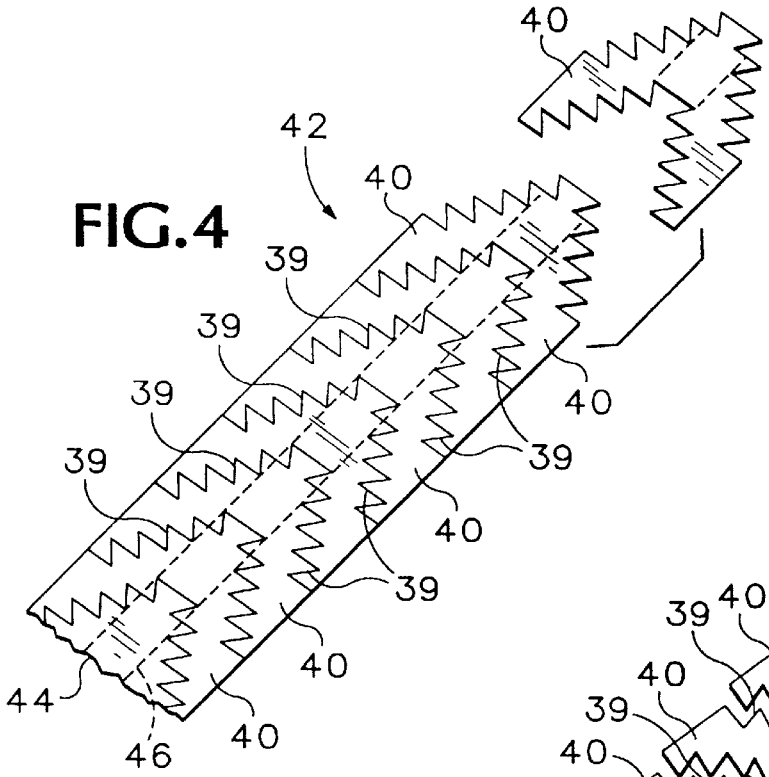
FIGS. 4 and 5 illustrate a flare ribbon product according to the present invention including serrated, angled, V-shaped die cuts for detachment of non-planar flare patterns along its length.
Figure 5:
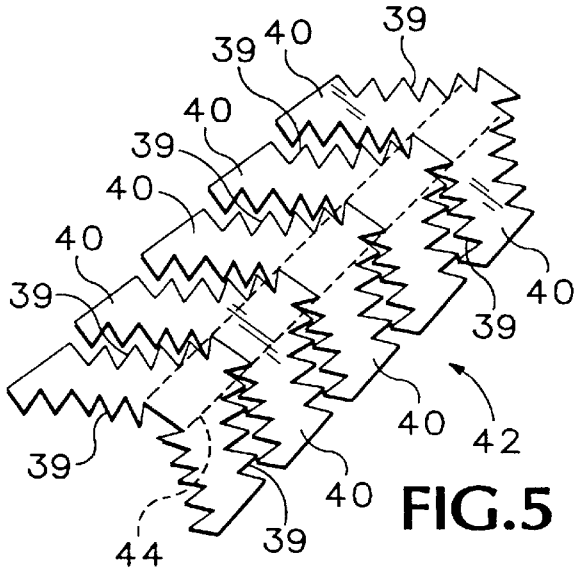
Figure 6:
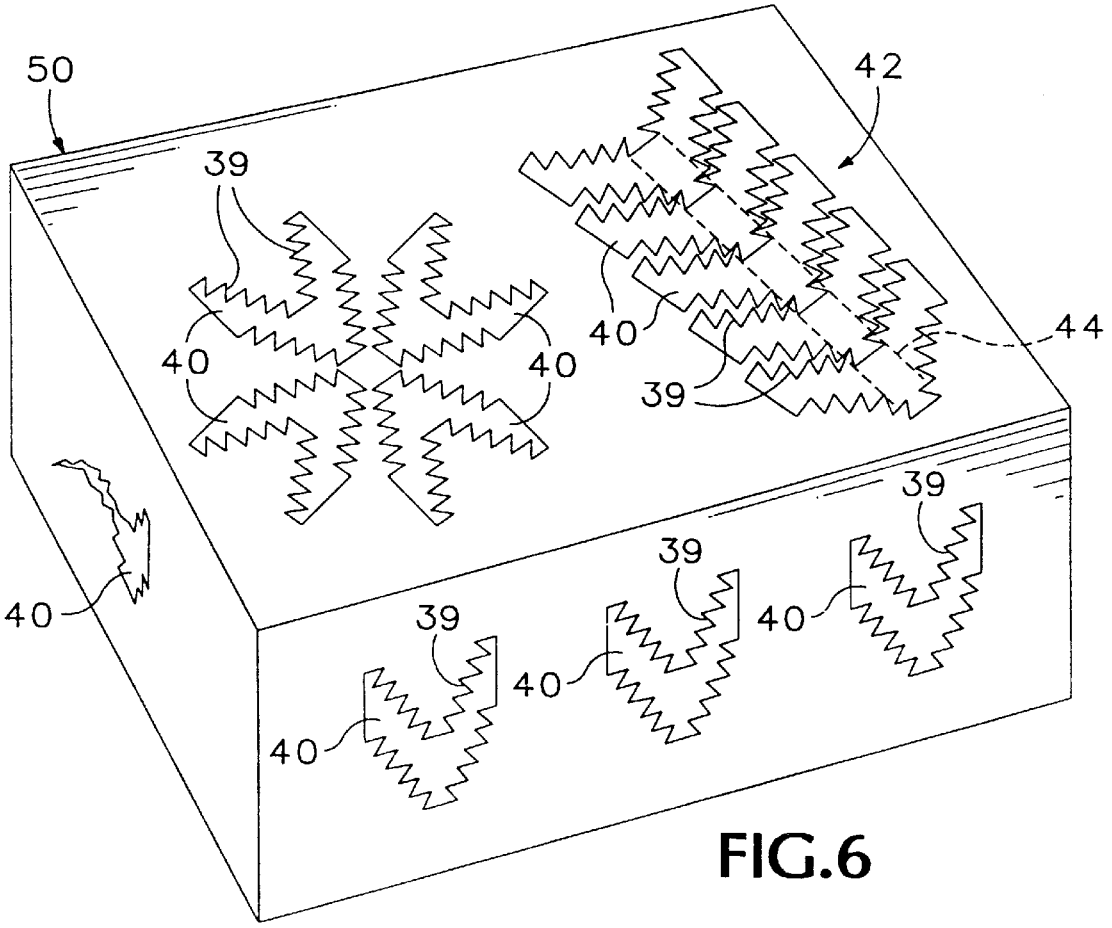
FIG. 6 illustrates use of the flare ribbon product of FIGS. 4 and 5 on a gift package including selected separation of individual flare portions for select placement on the package.

FIG. 4 illustrates a second embodiment of the present invention including serrated, angled, perforation cuts 39 forming V-shaped flare portions 40 along the length of a ribbon product 42. The ribbon product 42 is provided with a narrow strip of controllable adhesive 44 down the middle of the backside and a back strip 46 for protecting the controllable adhesive 44 in packaging of the ribbon product 42. FIG. 6 illustrates use of the ribbon product 40 by select placement of the ribbon 40 on a package 50. As may be appreciated, many variations in configuration and use of the ribbon product 42 are possible. For example, two such flare ribbon products 42, of different widths, may be used effectively with the narrower flare ribbon product 42 over the top of the wider flare ribbon product 42. The flare portions 40 may be selectively removed by tearing from the body of the product 42 and selectively placed according to user preference about the package 50 by use of adhesive 44.

Figure 7:
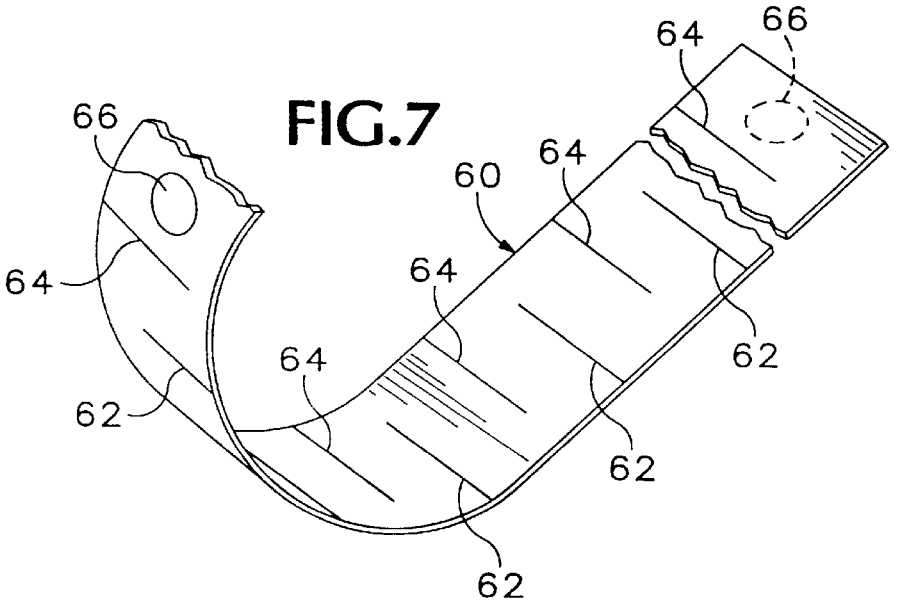
FIG. 7 illustrates a stretch ribbon product including alternating lateral die cuts along the length of the ribbon.

FIG. 7 illustrates a stretch ribbon product 60 according to the present invention. The stretch ribbon product 60 includes an elongate flat ribbon element having a width and a natural length. Along one length edge a first series of inward transverse cuts 62 extend beyond half the width of the ribbon element. Along the other length edge of the ribbon product 60 a second series of inward transverse cuts 64 also extend beyond half the width of the ribbon product 60. While shown as being straight and transverse, it should be understood that cuts 62 and 64 can be decorative as by serrated or angled cuts. The first and second series of transverse cuts 62 and 64, respectively, alternate along the length of the ribbon product 60 whereby upon application of longitudinal force, ribbon product 60 extends beyond its natural length.

FIG. 8 illustrates stretching of the ribbon product 60 beyond its natural length. The ribbon product 60 may also be provided with controllable adhesive spots 66 along its length for the purpose of attaching a segment of the stretch ribbon product 60 in its expanded length condition to a package 70.

A prominent effect so achieved is to allow the stretch ribbon to twist as it is extended, creating a striking appearance which will also improve the economy of the cost per extended length of the ribbon material as compared to the cost per natural length of the ribbon material. While applicable to a variety of ribbon materials, it is contemplated that the stretch ribbon is best suited for metallic nylon, plastic, or foil ribbons. Durability of the stretch ribbon product 60 can be enhanced by using ribbons with higher tensile strength, especially strength resisting transverse tearing, i.e., along the cuts 62 and 64, when longitudinal force is applied to the product 60. The stretch ribbon product 60 is also useful as a hanging decoration, i.e., as for a party decoration hanging from the ceiling or walls of a room. In such use of stretch ribbon product 60, a wider ribbon product, e.g., on the order of three inches wide, may be better suited for such hanging decorations.

Figure 9:
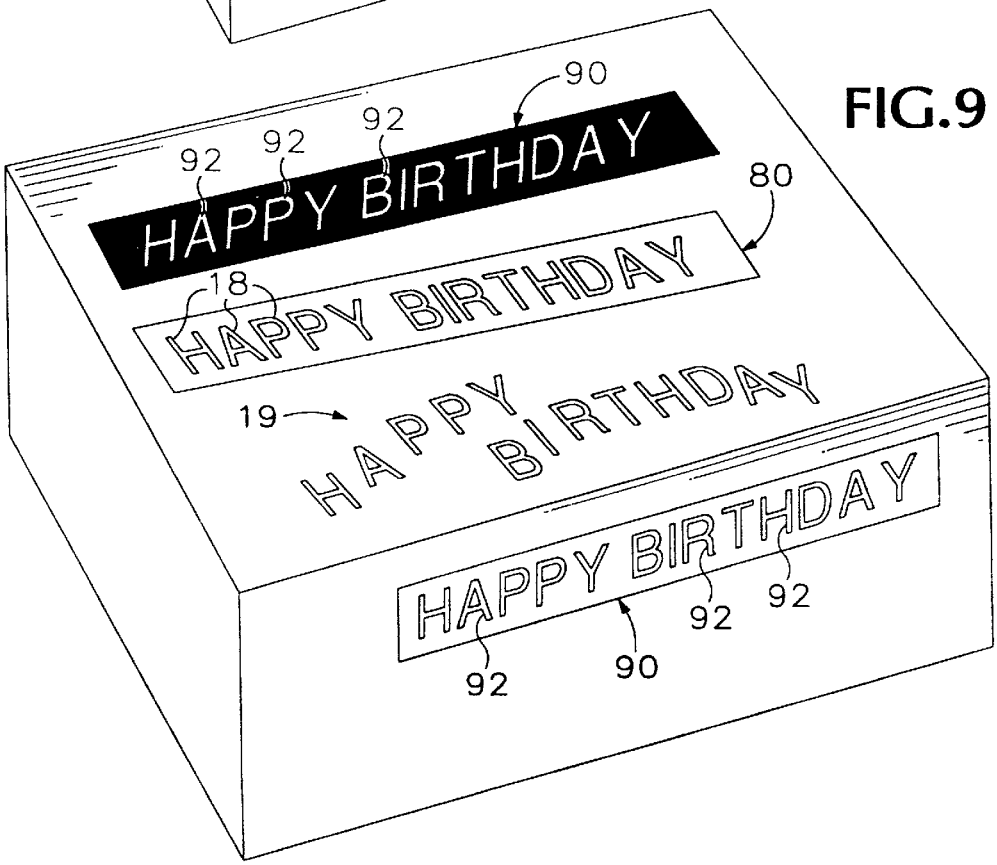
FIG. 9 illustrates a lettered embodiment of the present invention and a transparent embodiment of the present invention for providing coordination between ribbon color schemes and underlying wrapping paper color schemes.

FIG. 9 illustrates a ribbon product 80 according to another embodiment of the present invention wherein the stand-up portions 19 correspond to letters and a series of such stand-up portions 19 provides a message, e.g., "Happy Birthday" in the illustrated embodiment. Thus, by use of the ribbon product 80, the stand up portion 19 may be selectively removed from the ribbon product 80 and placed about a package, as illustrated in FIG. 9, or alternatively left attached to the ribbon product 80 in a planar pop-up configuration similar to that illustrated above. FIG. 9 also illustrates see-through ribbon products 90 wherein transparent windows 92 of the ribbon products 90 define letters or logos. Both the ribbon product 80 and the ribbon products 90 allow coordination between a wrapping paper color scheme and the color of the ribbon product. More particularly, by removing the stand-up portion 19 of the ribbon product 80, the underlying wrapper paper is visible and appears as part of the ribbon product 80 color scheme. Similarly, the windows 92 of ribbon products 90 allow visibility of the underlying wrapping paper whereby the color scheme of the underlying wrapping paper appears as part of the color scheme for the ribbon products 90. Both ribbon product 80 and ribbon products 90 may be provided with the above-described controllable adhesive to permit selective placement about a package.

The ribbon products shown herein may be produced according to a variety of known die cutting practices. For example, a punch press has been used successfully in producing prototype versions of the above ribbon products. It is contemplated, however, that a rotary die cutting machine be used for larger production quantities of the ribbon products described herein. Also, it is believed that laser die cutting machines may be used to implement the die cut of the present invention.

Figure 10:
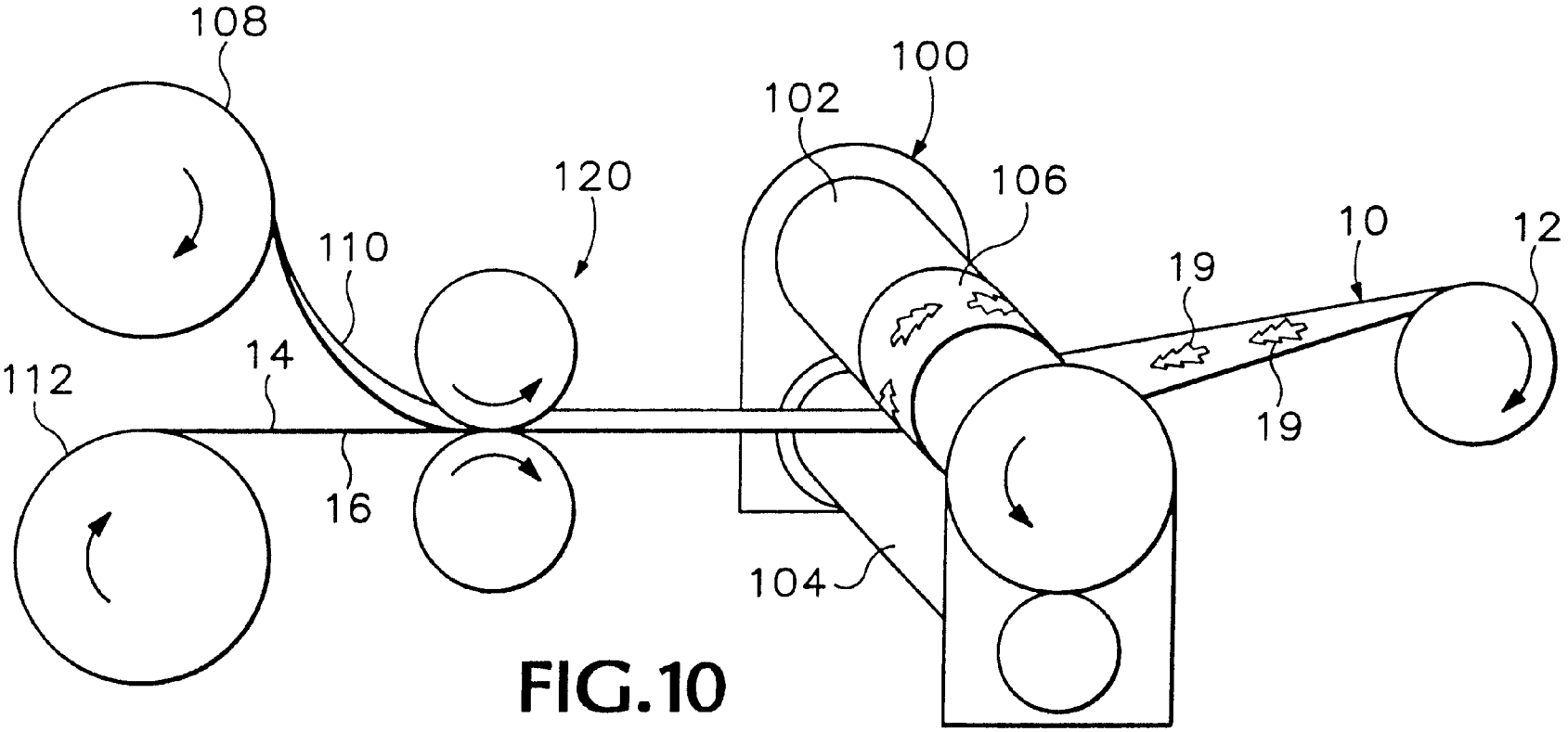
FIG. 10 illustrates schematically equipment for producing a ribbon in accordance with an embodiment of the invention.

FIG. 10 illustrates schematically a rotary die cutting machine 100 which includes an upper roller or cylinder 102 and a lower roller 104. The upper cylinder 102 carries a series of dies 106 for accomplishing the die cuts 18 as described herein. A ribbon source roll 108 delivers a ribbon element 110 and an adhesive source roll 112 delivers a controllable adhesive 14 as a double-sided tape-like product including the backing strip 16 thereon. A calendar set 120 with adjustable pressure points brings together the ribbon element 110 and the controllable adhesive 14 for delivery to the rotary die cutting machine 100. As the ribbon 110 and adhesive 14 pass between the rollers 102 and 104, the dies 106 accomplish the die cuts 18. The ribbon product 10 is then complete and collected on the roll 12. As may be appreciated, the ribbon element 110 could be provided with printed patterns and by suitably registering the ribbon 110 with the dies 106, such printed patterns could be positioned, e.g., made concentric to, the die cuts 18.

Thus an improved decorative packaging ribbon has been shown and described. The decorative packaging ribbon according to the present invention allows greater creative contribution on the part of the user in selection and placement of the product according to a desired presentation scheme. A user of the ribbon products under the present invention may employ the same ribbon products on two different packages, yet achieve substantially different presentation effects. The ribbon products according to the present invention also allow convenient use of shorter length segments relative to conventional ribbon products and thereby allow a user to include greater variety in ribbon presentation while not requiring correspondingly greater lengths of ribbon product. In other words, several types and colors of ribbon under the present invention may be included on a single package, but each ribbon segment may be of a selected length and need not surround entirely the package. While illustrated herein in the context of package decorations, the ribbon products of the present invention are well adapted for other uses such as in flower or plant arrangement including placement of stand up portions 19 upon the vase or jar and upon plant petals or leaves. Also, the ribbon products of the present invention are well adapted for personal ornamentation such as by providing a decorative bow or ribbon in the hair or upon clothing. In this regard, the use of controllable adhesive is particularly well suited for attachment to clothing and body parts. Furthermore, the ribbon products of the present invention are well suited for reuse. By virtue of the controllable adhesive on such ribbon products, the ribbon products may be selectively attached as desired according to a selected presentation criteria but later removed for reuse. In this regard, length sections of the ribbon product may be folded upon themselves such that the controllable adhesive temporarily joins and secures the ribbon in such folded configuration for storage. Also, as may be appreciated, such length portions can be rolled for storage. In either case, the controllable adhesive maintains such portions of ribbon products in their folded or rolled condition during storage, but allows unfolding or unrolling of the ribbon products for later use.

The ribbon products according to the present invention thereby advance the art of ribbon manufacture and use by providing greater user selection in presentation, especially with reference to three dimensional effects provided the present invention. Thus, the ribbon product of the present invention allows a user of relatively less experience to obtain greater presentation variation.

It will be appreciated that the present invention is not restricted to the particular embodiments that have been described and illustrated herein, and that variations may be made therein without departing from the scope of the invention as found in the appended claims and equivalence thereof. For example, while the present disclosure cannot illustrate variation in color and design appearance, e.g., as by printed designs, of the ribbon product shown herein, it should be understood that such ribbon products may assume a great variety of color schemes, texture schemes, and printed pattern according to practice in the industry. Ribbon products under the present invention may, therefore, include additional printing patterns which correspond to or enhance the die cut patterns to enhance the overall presentation effect. For example, the heart shaped die cuts 18 of the embodiment of FIGS. 1 and 2 may be complemented with corresponding heart shaped printing patterns 17 on the product 10 either concentrically or alternating along the length of the ribbon.

What is claimed is:

1. A decorative are ribbon comprising:

a) an elongated flat ribbon element having opposite longitudinally extending lateral edges defining the normal width of the ribbon element, b) a plurality of longitudinally spaced lines of serrated cuts of generally V-shape extending the full width laterally outward from the central longitudinal portion of the ribbon element and at an acute angle relative to the longitudinal direction of the ribbon element and terminating at said opposite lateral edges, and c) an adhesive on a central longitudinal portion of the decorative ribbon element for attachment of said central portion to an underlying surface, d) the ribbon element being separable along at least portions of the cuts to form V-shaped segments defined between adjacent cuts, the V-shaped segments being extendable laterally to lengths greater than the normal width of the ribbon element.

2. A decorative flare ribbon comprising:

a) an elongated flat ribbon element having opposite longitudinally extending lateral edges defining the normal width of the ribbon element, b) a plurality of longitudinally spaced lines of serrated cuts of generally V-shape extending the full width laterally outward from the central longitudinal portion of the ribbon element and at an acute angle relative to the longitudinal direction of the ribbon element and terminating at said opposite lateral edges, and c) an adhesive on a central portion of the V-shaped segments, d) the ribbon element being separable along the entire transverse lines of serrated perforation cut lines to form a plurality of V-shaped segments, the V-shaped segments being extendable laterally to lengths greater than the width of the ribbon element.

3. The decorative flare ribbon of claim 1 wherein the adhesive is a controllable adhesive.

4. The decorative flare ribbon of claim 2 wherein the adhesive is a controllable adhesive.

* * * * *